US006142768A

United States Patent [19]

Feng et al.

[11] Patent Number: 6,142,768

[45] **Date of Patent: *Nov. 7, 2000**

[54] CIGARETTE LIGHTER WITH SECURITY ARRANGEMENT

[76] Inventors: Xin Feng, 17070 E. Colima Rd., #281, Hacienda Heights, Calif. 91745; Biao Zheng, 6B Shizheng Road, 2-1-101, Shijiazhuang, Hebei, China

[ * ] Notice: This patent is subject to a terminal disclaimer.

[21] Appl. No.: 09/289,573

[22] Filed: Apr. 10, 1999

Related U.S. Application Data

[63] Continuation-in-part of application No. 09/263,332, Mar. 4, 1999.

[51] Int. Cl.[7] ..... F23D 11/36; F23Q 1/02

[52] U.S. Cl. ..... 431/153; 431/277

[58] Field of Search ..... 431/277, 153, 431/255

[56] References Cited

U.S. PATENT DOCUMENTS

| | | | |
|---|---|---|---|
| 1,872,244 | 8/1932 | Clark et al. . | |
| 3,465,355 | 9/1969 | Van Poppel | 431/138 |
| 5,096,414 | 3/1992 | Zellweger | 431/153 |
| 5,547,370 | 8/1996 | Hwang | 431/153 |
| 5,655,902 | 8/1997 | Doucet | 431/153 |
| 5,759,023 | 6/1998 | Jenlis | 431/153 |
| 5,846,069 | 12/1998 | Sher | 431/153 |
| 5,868,561 | 2/1999 | Rogelet | 431/153 |
| 5,913,674 | 6/1999 | Shimizu | 431/153 |
| 5,997,281 | 12/1999 | Lei | 431/153 |

FOREIGN PATENT DOCUMENTS

| | | | |
|---|---|---|---|
| 8-14559 | 1/1996 | Japan | 431/277 |

*Primary Examiner*—Carl D. Price

*Attorney, Agent, or Firm*—Raymond Y. Chan; David and Raymond

[57] ABSTRACT

A cigarette lighter includes an ignition means which includes a flint supported by a resilient element, a spark producing element and a pair of side driving wheels. The two side driving wheels are rotatably covered on two end portions of the spark producing element respectively, so that the two end portions of the spark producing element are respectively inserted into the two driving sockets of the two side driving wheels while the flint upwardly extending between the two side driving wheels and urging against the spark producing element. Normally, the two side driving wheels are disengaged with the spark producing element to prevent a minor from driving the spark producing element to rotate, however in order to ignite the Cigarette lighter, an adult must apply a digital force on said side driving wheels in order to rotate said two side driving wheels to drive said spark producing element to rotate and strike against said flint to generate sparks.

4 Claims, 7 Drawing Sheets

CIGARETTE LIGHTER WITH SECURITY ARRANGEMENT

CROSS REFERENCE OF RELATED APPLICATION

This application is a Continuation-In-Part Application of a previous application, filed on Mar. 4, 1999, having an application Ser. No. of 09/263332.

FIELD OF THE PRESENT INVENTION

The present invention relates to cigarette lighter, and more particular to a cigarette lighter with security arrangement to ensure the security of wrong usage by children, especially under 5 years old.

BACKGROUND OF THE PRESENT INVENTION

For protecting the safety and benefit of children, starting from July 1993, the U.S. Consumer Product Safety Commission declared that it should stop selling the traditional cigarette lighter. In view of protecting the safety of children, it is absolutely necessary and reasonable to do so. Therefore, the U.S. Consumer Product Safety Commission imposed an important regulation that requires certain cigarette lighters must be Child resistant.

However, most conventional safety lighters, presently in use, have some weaknesses on usage under a certain circumstances. For example, U.S. Pat. No. 5,096,414 owned by Zellweger, as shown in FIG. 1, discloses a striker wheel acting on a spark stone. The striker wheel is disposed between two plates which have greater diameter and are freely rotatable with respect to the wheel. Actuation of this latter is obtained by friction thanks to the deformation of the pulp of the thumb of the user, and may not be driven by a child as the pulp of the finger of children is not sufficiently thick. The problem to the above prior art is that the fact of the matter is that the pulp of the finger of a young child can still easily make contact with the striker wheel as long as the position of the child's finger is correct.

Another example is U.S. Pat. No. 5,547,370, owned by Hwang, which is a further improvement of Zellweger's patent. Similar to Zellweger's patent, Hwang's patent also includes a wheel axle mounted between two upright supports at the top of a butane wheel, two driving wheels mounted around the wheel axle between the upright supports, and a striker wheel fixedly mounted around the wheel axle and disposed in contact with a spring-supported flint below and turned by the driving wheels through the wheel axle to strike the spring-supported flint in producing sparks. The improvement is that the wheel axle is made of polygonal cross section, having two round rods at two opposite ends loosely inserted into a respective axle hole on each upright support so as to ensure a better connection between the striker wheel and the wheel axle.

However, the Hwang's patent still bears the drawbacks including higher cost and malfunctioning. Its assembly cost is higher because special care and measurement must be applied to ensure the striker wheel is located in a center position of the wheel axle. The central polygonal hole of the striker wheel must be exactly equal to the size of the polygonal wheel axle. If it is too small, it is impossible to insert the wheel axle therethrough. It is too big, the striker wheel may not be firmly held in center position. How to punch in the polygonal wheel axle through the polygonal hole of the striker wheel and how to ensure the striker wheel located in the central position of the wheel axle become a headache of Hwang's patent. Moreover, a slight clearance would be existed between the striker wheel and the wheel axle so as to facilitate the polygonal wheel axle to insert through the central polygonal hole of the striker wheel. Normally, the rotation of the wheel axle can drive the striker wheel to rotate with no problem. But, the striker wheel may gradually move aside after using for a period of time. If such condition happens, the center of the striker wheel will not remain aligning with the flint properly, that may unavoidably affect the ignition of the lighter and cause malfunction. The tip of the flint may get stuck between the driving wheel and the striker wheel.

SUMMARY OF THE PRESENT INVENTION

A main object of the present invention is to provide a cigarette lighter with security arrangement that can only be ignited by adults, in order to ensure the security from young children by preventing ignition from the thumb or fingers of young child.

Another object of the present invention is to provide a cigarette lighter with security arrangement that minimizes the contacting area between the user's thumb and the spark producing element for striking against the dirty flint.

Another object of the present invention is to provide a cigarette lighter with security arrangement that does not employ any expensive and complicate mechanism so as to maintain the low cost of the cigarette lighter manufacturing.

Another object of the present invention is to provide a cigarette lighter with security arrangement that can ensure a good contact between the spark producing element and the flint.

In order to accomplish the above objects, the present invention provides a cigarette lighter with security arrangement which comprises a supporting frame disposed on a gas reservoir having a valve which is actuated by a gas lever pivotally mounted on the supporting frame for actuating the valve to release gas within the gas reservoir therefrom, wherein the supporting frame comprises two supporting walls parallelly protruded on opposite sides of the gas lever and each of the supporting walls has a supporting hole provided thereon. The cigarette lighter further comprises an ignition means. The ignition means comprises a flint supported by a resilient element, a spark producing element and a pair of side driving wheels.

The spark producing element is rotatably mounted on the supporting frame, wherein the spark producing element has a plurality of striking teeth provided on an outer circumferential surface thereof, and the flint is supported by the resilient element to upwardly urging against a bottom portion of the striking teeth of the spark producing element.

The two side driving wheels each has a central supporting hole, wherein the two side driving wheels are two symmetrical cap bodies each having a U-shaped cross section. A circular striking socket is formed at an inner side of each of the side driving wheels, in which each of the driving sockets has an inner circumferential driving surface. The two side driving wheels are rotatably covered on two end portions of the spark producing element respectively, so that the two end portions of the spark producing element are respectively inserted into the two driving sockets of the two side driving wheels while the flint upwardly extending between the two side driving wheels and urging against the spark producing element.

Accordingly, the two side driving wheels are normally disengaged with the spark producing element to prevent a minor from driving the spark producing element to rotate, however in order to ignite the cigarette lighter, an adult must apply a digital force on the side driving wheels in order to rotate the two side driving wheels to drive the spark producing element to rotate and strike against the flint to generate sparks.

DETAILED DESCRIPTION OF THE PREFERRED EMBODIMENT

Figure 1:
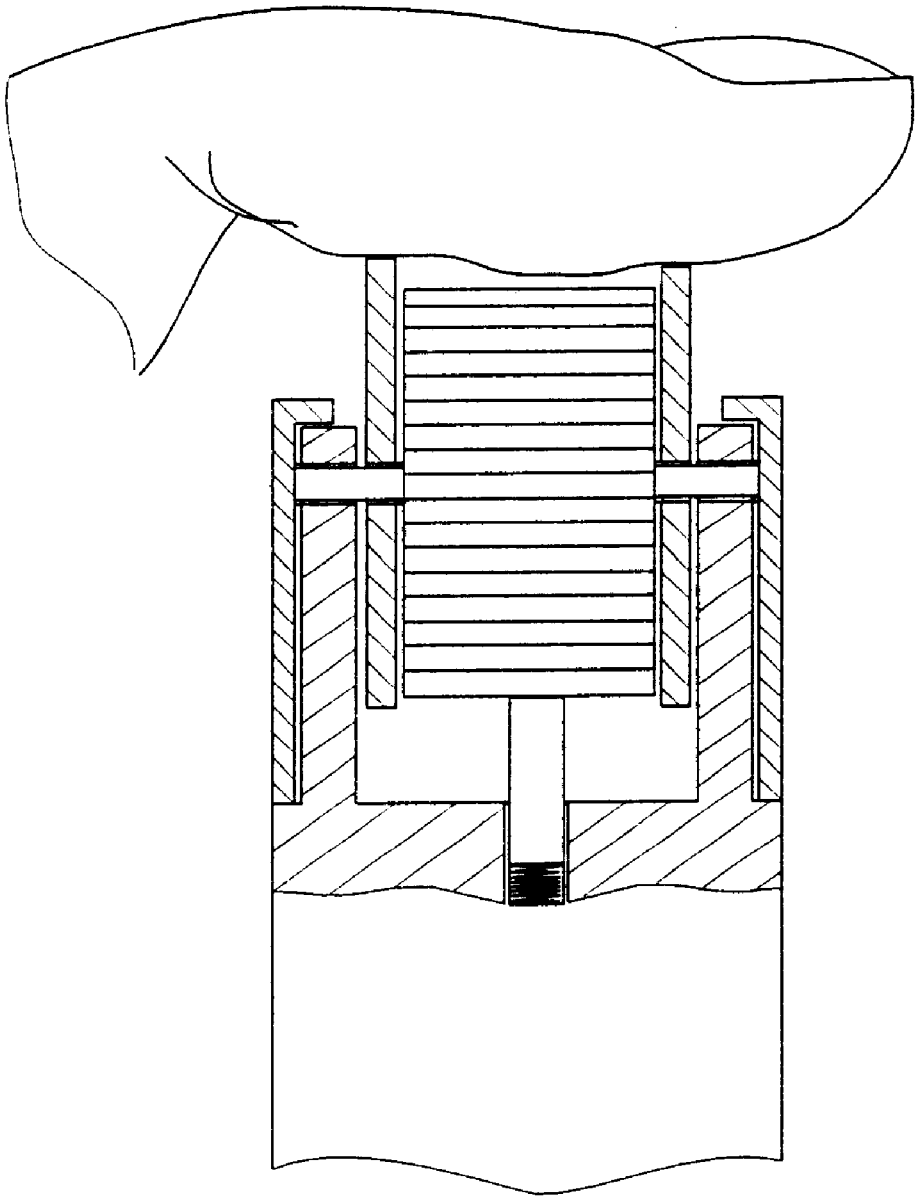
FIG 1 (PRIOR ART)
FIG. 1 is a partial sectional view of a conventional cigarette lighter.
Figure 2:
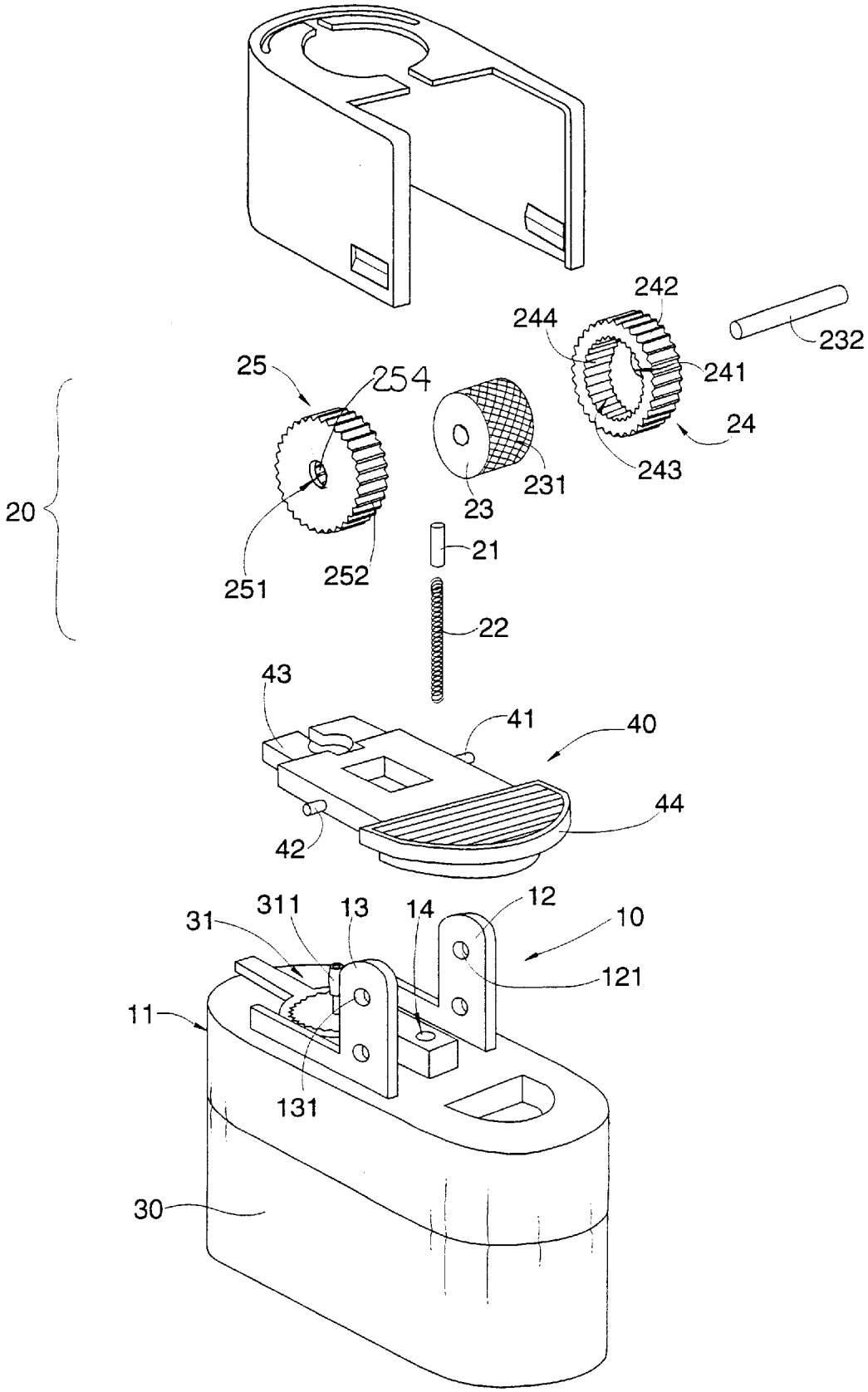
FIG. 2 is an exploded perspective view of a cigarette lighter with security arrangement according to a preferred embodiment of the present invention.
Figure 3:
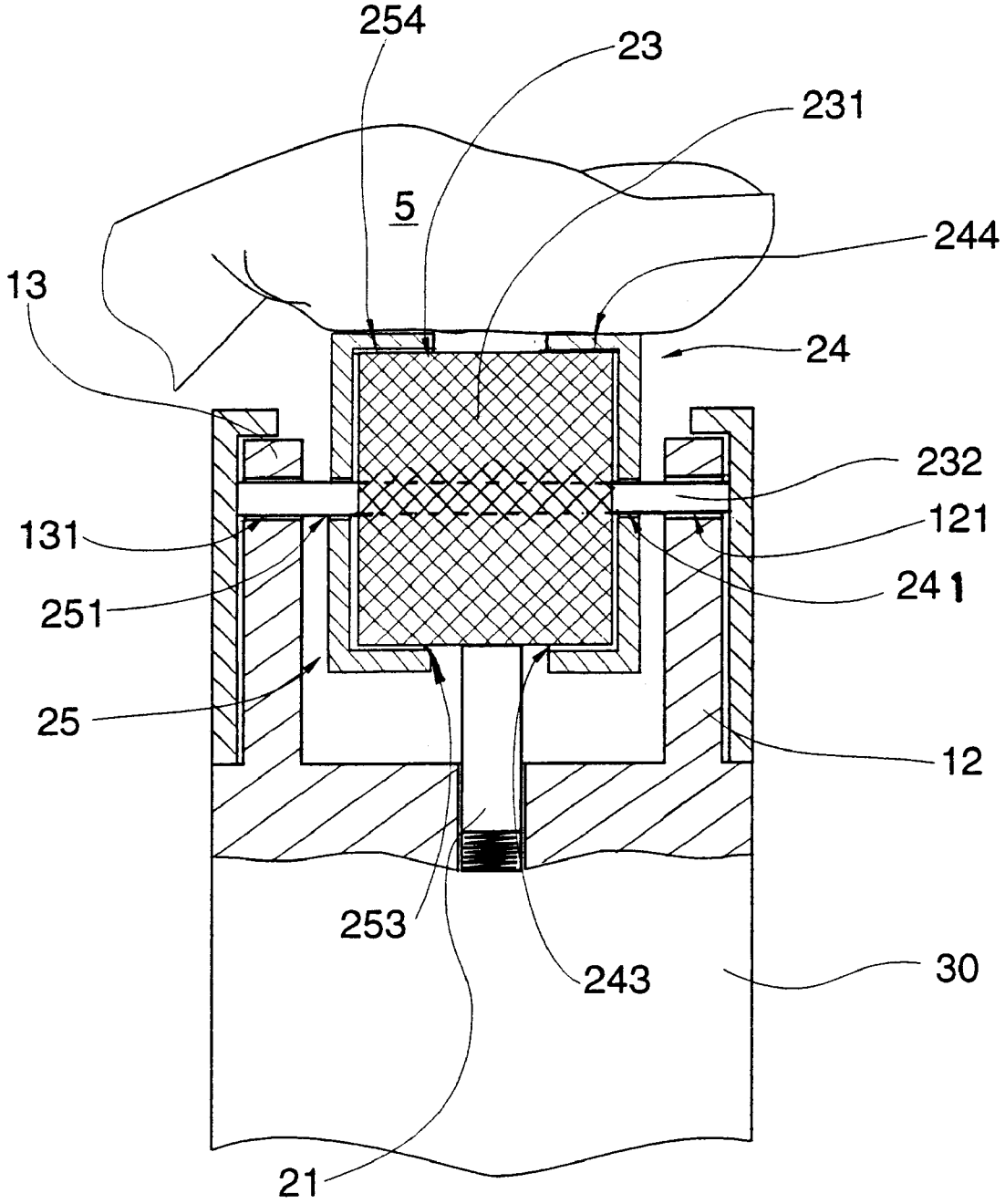
FIG. 3 is a partial sectional side view of the cigarette lighter with security arrangement according to the above preferred embodiment of the present invention.
Figure 4:
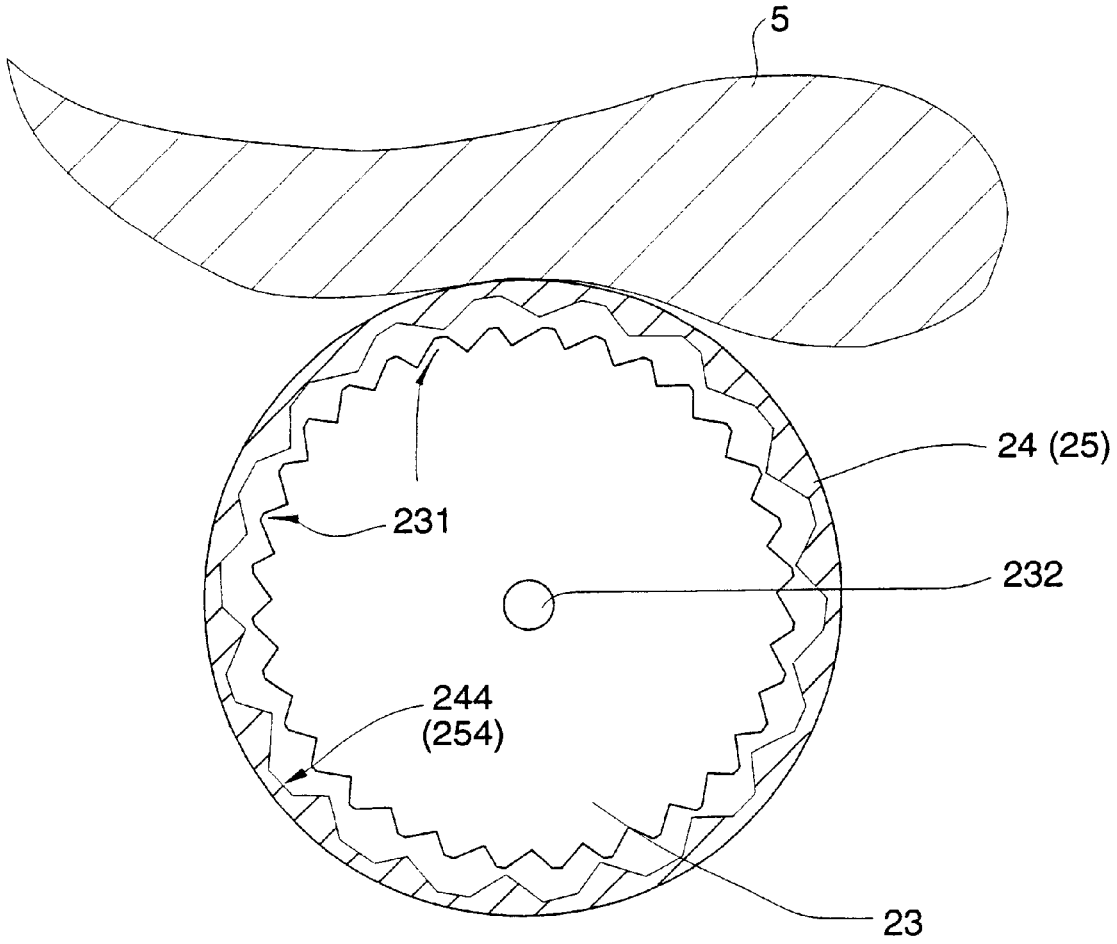
FIG. 4 is a schematic view illustrating the relationship between the spark producing element and the side driving wheel according to the above preferred embodiment of the present invention.

Referring to FIGS. 2, 3 and 4 of the drawings, a cigarette lighter of the present invention comprises a supporting frame 10 and an ignition means 20. The supporting frame 10 is disposed on a gas reservoir 30 having a valve 31 which is actuated by a gas lever 40 pivotally mounted on the supporting frame 10 for releasing gas therefrom. The supporting frame 10 is protruded from a frame cover 11 sealedly secured onto the gas reservoir 30 filled with liquid petroleum gas such as butane therein.

The supporting frame 10 comprises a pair of supporting walls 12, 13 protruded on opposite sides of the gas lever 40. The gas lever 40 is pivotally mounted between the two supporting walls 12, 13 by means of two pivots 41, 42 protruded from two opposite sides of the gas lever 40. The gas lever 40 has a front end 43 extending frontward to engage with a nozzle 311 of the gas valve 31 and a depressable rear end 44 extending rearwards of the frame cover 11 for enabling the depressing of the depressable rear end 44 for lifting up the gas nozzle 311 to open the gas valve 31.

The ignition means 20 comprises a flint 21 supported by a resilient element 22 and a spark producing element 23 which is rotatably mounted on the supporting frame 10. The spark producing element 23 has a plurality of striking teeth 231 provided on its outer circumferential surface. The flint 21 is supported by the resilient element 22 to upwardly press against a bottom portion of the striking teeth 231 of the spark producing element 23. Each of the supporting walls 12, 13 has a circular supporting hole 121, 131 provided thereon for mounting a wheel shaft 232 of the spark producing element 23 between the two supporting walls 12, 13.

The flint 21 and the resilient element 22 are received in a flint housing 14 which is underneath the spark producing element 23 and provided on the frame cover 10 between the two supporting walls 12, 13. An upper portion of the flint 21 must be retained exposing outside the flint housing 14 and urging against the striking teeth 231 of the spark producing element 23 by means of the resilient element 22. In order to ignite the lighter, sparks must be generated and directed toward the gas valve 31 by driving the striking teeth 231 to turn against the flint 21.

The cigarette lighter of the present invention specifically employs a security arrangement for the ignition means 20 which comprises a pair of side driving wheels 24, 25. Each of the driving wheels 24, 25 has a central supporting hole 241, 251 and an outer kurling surface 242, 252 adapted for better contact by a user. The two side driving wheels 24, 25 are two symmetrical caps bodies each having a U-shaped cross section. Therefore, a circular striking socket 243, 253 is formed at an inner side of each of the side driving wheels 24, 25. Each of the driving sockets 243, 253 has a plurality of driving teeth 244, 254 evenly distributed on its inner circumferential driving surface.

As shown in FIG. 3, the depth of each of the driving socket 243, 253 must be smaller than half the length of the spark producing element 23. Preferably, the total depth of the two driving sockets 243, 253 of the two side driving wheels 24, 25 must be smaller than the length of the spark producing element 23 for an amount at least slightly larger than the diameter of the flint 21.

Two ends of the wheel shaft 232 are respectively penetrated through the two supporting holes 241, 251 of the two side driving wheels 24, 25, so as to rotatably supported the two side driving wheels 24, 25 at two sides of the spark producing element 23 respectively, wherein both the central supporting holes 241, 251 of the two side driving wheels 24, 25 have a diameter larger than the diameter of the wheel shaft 232, so that the two side driving wheels 24, 25 are capable of free rotating about the wheel shaft 232.

As shown in FIG. 3, the two side driving wheels 24, 25 are respectively covered on the two end portions of the spark producing element 23. In other words, the two end portions of the spark producing element 23 are respectively inserted into the two driving sockets 243, 253 of the two side driving wheels 24, 25 while the top end of the flint 21 upwardly extending between the two side driving wheels 24, 25 and propping against a central portion of the spark producing element 23.

As shown in FIG. 4, according to the preferred embodiment of the present invention, the spark producing element 23 is preferably to have a larger even number (such as thirty-two) of the striking teeth 232 and each of the side driving wheels 24, 25 has a smaller odd number (seventeen or nineteen) of the driving teeth 244, 254. Moreover, as shown in FIGS. 3 and 4, the diameter of each of the driving sockets 243, 253 of the two side driving wheels 24, 25 are larger than the outer diameter of the spark producing element 23, therefore the striking teeth 232 and the driving teeth 244, 254 are dispositioned, so that the two side driving wheels 24, 25 are normally in free rotating stage.

As illustrated in FIG. 3, most of the spark producing element 23 is covered by the two side driving wheels 24, 25 which are normally disengaged with the spark producing element 23, SO that a 4 years old child basically can not reach the spark producing element 23 with his or her thumb or fingers. In order to ignite the cigarette lighter of the present invention, as shown in FIG. 4, an adult user must simultaneously process the following two steps with his or her thumb 5: First, press down the two side driving wheels 24, 25 until a top portion of the driving teeth 244, 245 thereof are engaged with a top portion of the striking teeth 231. Second, to rotate the two side driving wheels 24, 25 to drive the spark producing element 223 to rotate and strike against the flint 21 to generate sparks. However, the small thumb pressure of a child is unable, at the same time, to effectively press down the two side driving wheels 24, 25 to align a top portion of the driving teeth 244, 245 thereof with a top portion of the striking teeth 231, to ensure the engagement of between the striking teeth 231 and the driving teeth 244, 254, and to rotate the two side driving wheels 24, 25. Therefore, a safety purpose of preventing a small child to ignite the cigarette lighter of the present invention can thus be achieved.

Figure 5:
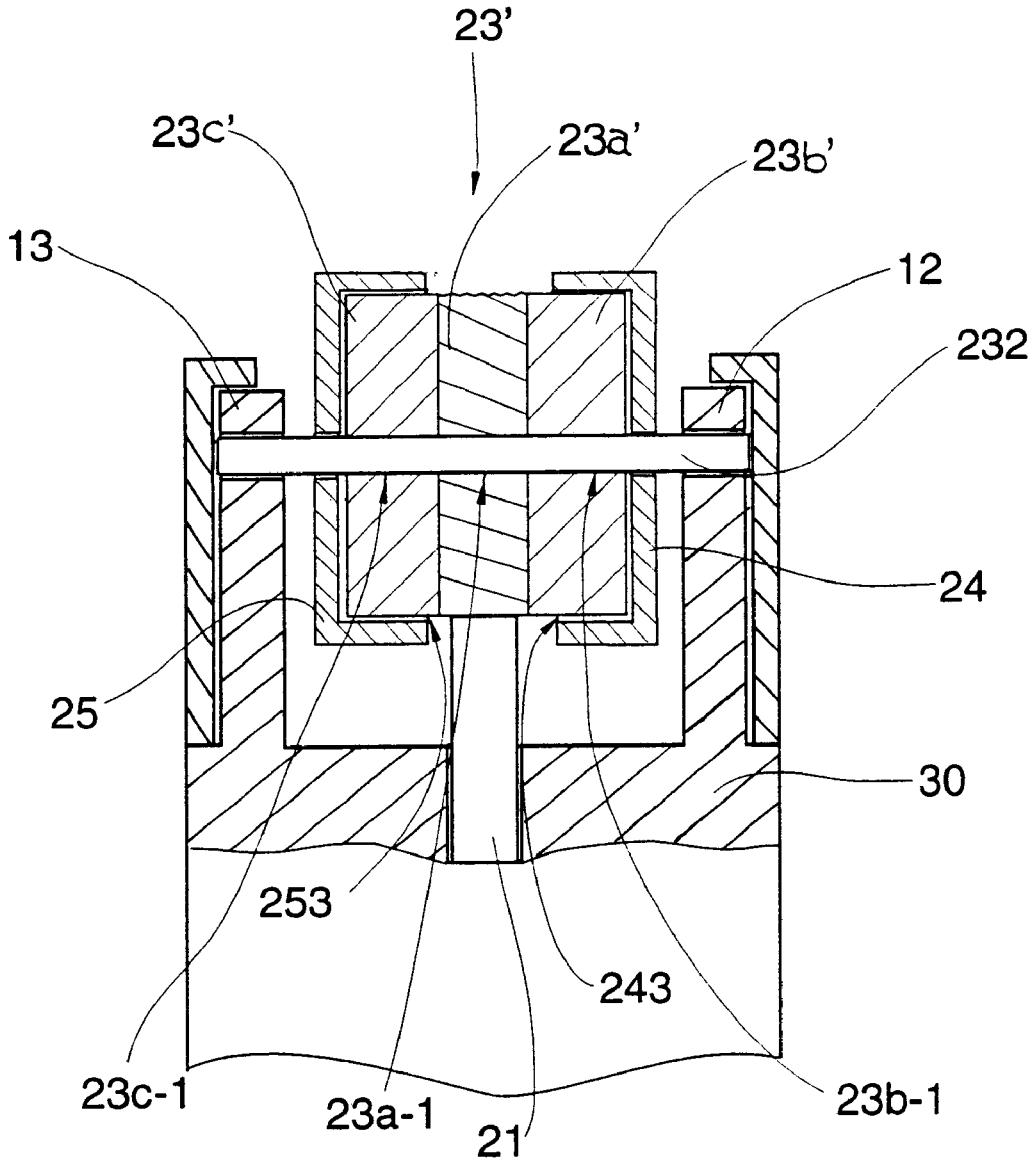
FIG. 5 is a partial sectional side view of the cigarette lighter with security arrangement according to a first alternative mode of the preferred embodiment of the present invention.

Referring to FIG. 5, an alternative mode of the preferred embodiment of the present invention as shown in FIGS. 2 to 4 is illustrated. The alternative mode basically has an identical structure as of the above preferred embodiment, except the spark producing element 23' is modified from an integral one body structure to a combining configuration in order to lower the material cost. It is because expensive heat treatment has to process for producing the spark producing element 23 in order to effectively work with the flint 21 to generate spark. However, only a central portion of the spark producing element 23 is substantially in contact with the flint 21.

According to this alternative mode, the spark producing element 23' comprises a central spark producing element 23*a'* and two side turning wheels 23*b'*, 23*c'* which have the same diameter of the central spark producing element 23*a'* and are welded to two sides of the central spark producing element 23*a'*, wherein the central spark producing element 23*a'* and the two side turning wheels 23*b'*, 23*c'* each has an axial shaft hole 23*a*-1, 23*b*-1 and 23*c*-1 to form an axial through hole for integrally connected with the wheel shaft 232. Accordingly, the central spark producing element 23*a'* is arranged to strike against the flint 21, and the two side turning wheels 23*b'*, 23*c'* that are used to engage with the two side driving wheels 24, 25 can be made of regular steel or other metal having cheaper cost. The two side driving wheels 24, 25 are capped on the two side turning wheels 23*b'*, 23*c'* respectively. In other words, the two side turning wheels 23*b'*, 23*c'* are respectively positioned in the two driving sockets 243, 253 of the two side driving wheels 24, 25. Therefore, by increasing the thickness of the two side turning wheels 23*b'*, 23*c'* can not only increase the overall width of the spark producing element 23' but also increase the engaging area between side turning wheels 23*b'*, 23*c'* and the two side driving wheels 24, 25.

Figure 6:
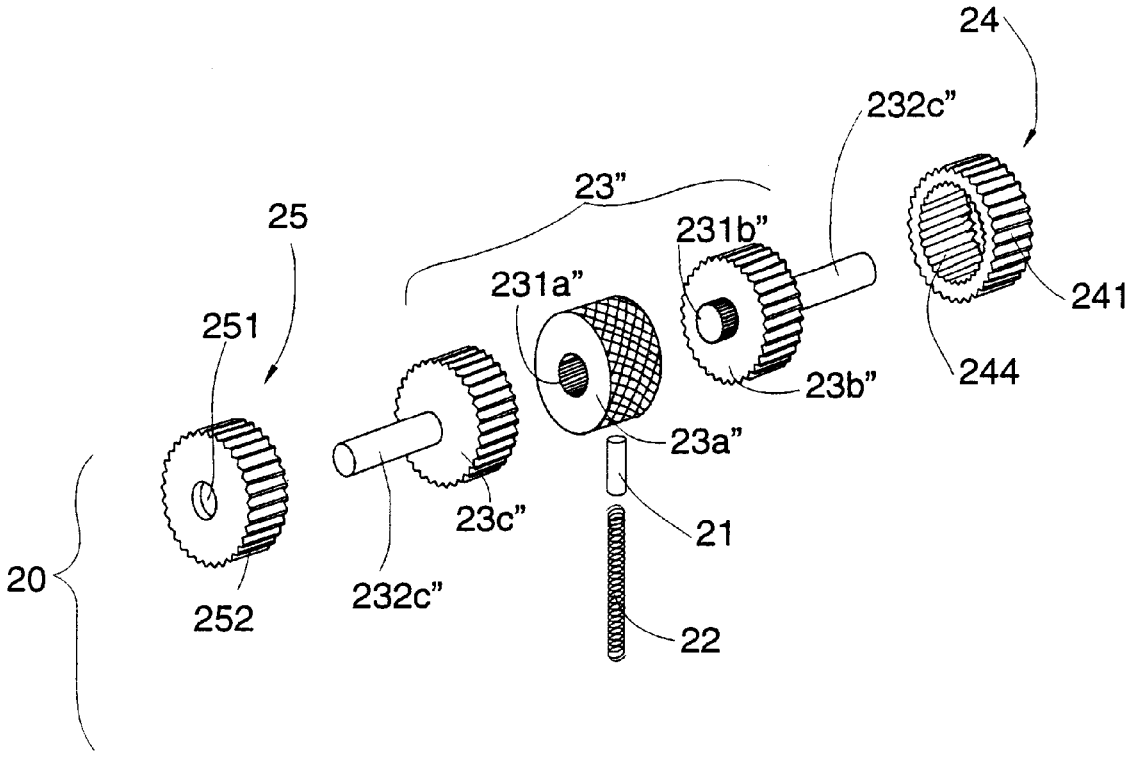
FIG. 6 is an exploded perspective view of an ignition means of a cigarette lighter with security arrangement according to a second alternative mode of the above preferred embodiment of the present invention.
Figure 7:
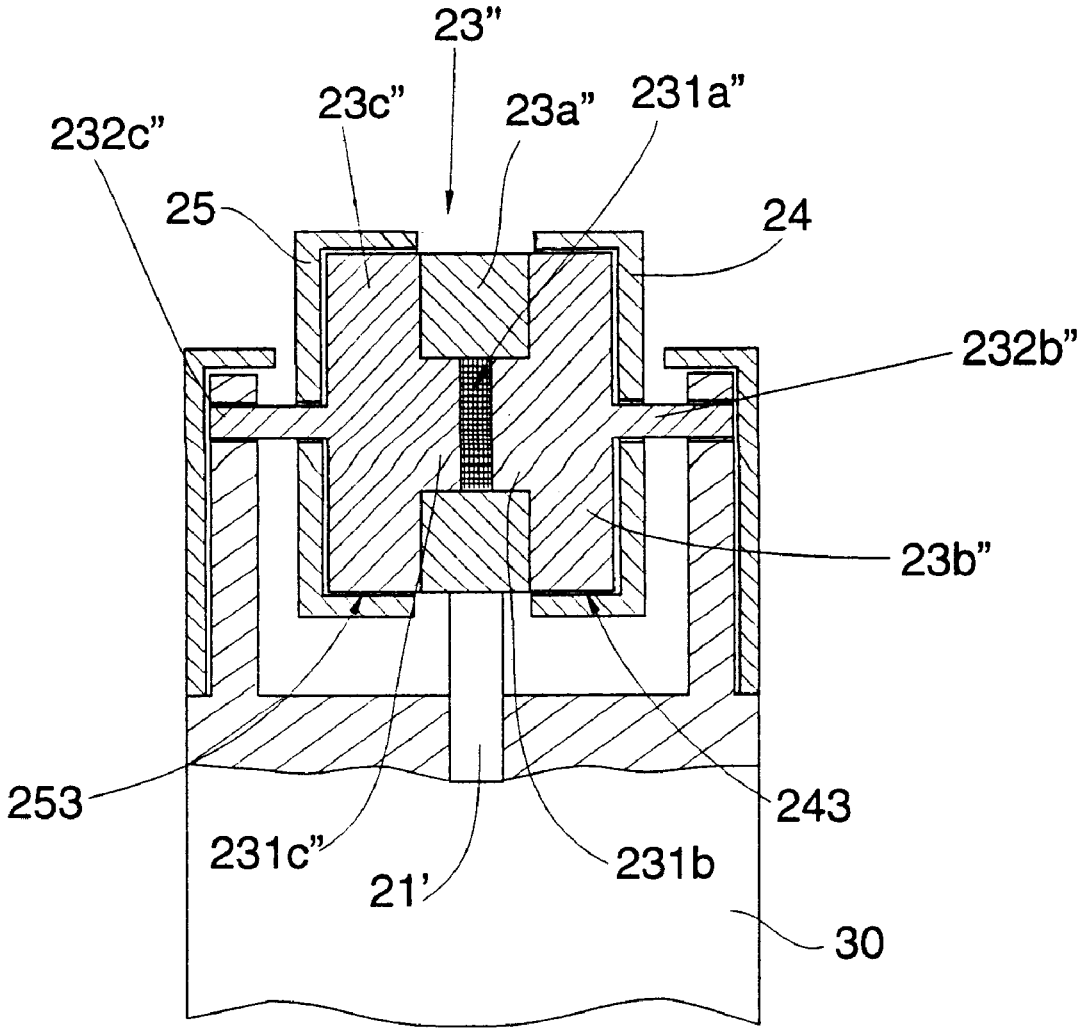
FIG. 7 is a partial sectional side view of the cigarette lighter with security arrangement according to the above second alternative mode of the preferred embodiment of the present invention.

Referring to FIGS. 6 and 7, another alternative mode of the preferred embodiment of the present invention is illustrated, which can be found in a conventional cigarette lighter comprises a central spark producing element 23*a"* and two side turning wheels 23*b"*, 23*c"* which have the same diameter of the central spark producing element 23*a"*. The central spark producing element 23*a"* has an axial driven hole 231*a"*. Each of the side turning wheels 23*b"*, 23*c"* further has an connecting stub 231*b"*, 231*c"* integrally and axially protruded from an inner side thereof and a supporting shaft 232*b"*, 232*c"* integrally and axially extended from an outer side thereof As shown in FIGS. 7, the central spark producing element 23*a"* and the two side turning wheels 23*b"*, 23*c"* are firmly connected to form a single wheel body by firmly engaging the two connecting stubs 231*b"*, 231*c"* of the two side turning wheels 23*b"*, 23*c"* into the two ends of the axial driven hole 231*a"*. Moreover, the two supporting shafts 232*b"*, 232*c"* form a supporting shaft for rotatably mounting the spark producing element 23" between the supporting walls 12, 13. In other words, the wheel shaft 232 as shown in FIGS. 2 to 4 of the above embodiment can thus be eliminated.

Similarly, the two side driving wheels 24, 25 are capped on the two side turning wheels 23*b"*, 23*c"* respectively. In other words, the two side turning wheels 23*b"*, 23*c"* are respectively positioned in the two driving sockets 243, 253 of the two side driving wheels 24, 25. Through this preferred embodiment, a conventional lighter can be easily modified into a child resistant lighter by simply cover the turning wheels with additional two driving wheels.

In view of above, the present invention provides a security arrangement that can only be ignited by adults, so as to ensure the security from young children by preventing ignition from the thumb or fingers of young child. The security arrangement does not employ any expensive and complicate mechanism so as to maintain the low cost of the cigarette lighter manufacturing. Moreover, the present invention minimizes the contacting area between the user's thumb and the spark producing element for striking against the dirty flint and can ensure a good contact between the spark producing element and the flint.

What is claimed is:

1. A cigarette lighter, comprising:

a supporting frame disposed on a gas reservoir having a valve which is actuated by a gas lever pivotally mounted on said supporting frame for actuating said valve to release gas within said gas reservoir therefrom, wherein said supporting frame comprises two supporting walls parallelly protruded on opposite sides of said gas lever; and an ignition means comprising:

a flint supported by a resilient element;

a spark producing element, which is rotatably mounted between said two supporting walls of said supporting frame, comprising a central spark producing element and two side turning wheels which are coaxially connected to two sides of said central spark producing element respectively, wherein each of said two side turning wheels has a diameter equal to a diameter of said central spark producing element, and that said central spark producing element has a plurality of striking teeth provided on an outer circumferential surface thereof, and said flint is supported by said resilient element to upwardly urging against a portion of said striking teeth at position on said outer circumferential surface of said spark producing element at a location adjacent an end of said flint; and a pair of side driving wheels each having a central supporting hole, wherein said two side driving wheels are two symmetrical cap bodies each having a U-shaped cross section, and that a circular striking socket is formed at an inner side of each of said side driving wheels, in which each of said driving sockets has an Inner circumferential driving surface, said two side driving wheels being rotatably covered on said two side turning wheels and said two side turning wheels are respectively inserted into said two driving sockets of said two side driving wheels while said flint upwardly extending between said two side driving wheels and urging against said central spark producing element, and that said two side driving wheels are dimensioned such that said two side driving wheels are normally disengaged with said two side turning wheels respectively for preventing a minor from driving said spark producing element to rotate, wherein said central spark producing element and said two side turning wheels each has an axial shaft hole to form an axial through hole for integrally connected with said wheel shaft, wherein each of said side turning wheels has a plurality of striking teeth Provided on an outer circumferential surface thereof and said inner circumferential driving surface has a plurality of driving teeth evenly distributed thereon, wherein each of said two side turning wheels has a larger even number of said striking teeth than an odd number of said driving teeth of each of said side driving wheels;

thereby, in order to ignite said cigarette lighter, an adult must apply a digital force on said side driving wheels in order to rotate said two side driving wheels to drive said spark producing element to rotate and strike against said flint to generate sparks.

2. A cigarette lighter as recited in claim 1 wherein said central spark producing element having an axial driven hole, each of said side turning wheels further having an connecting stub integrally and axially protruded from an inner side thereof and a supporting shaft integrally and axially extended from an outer side thereof, in which said central spark producing element and said two side turning wheels are firmly connected to form a single wheel body by firmly engaging said two connecting stubs of said two side turning wheels into said two ends of said axial driven hole, and that said two supporting shafts form a supporting shaft for rotatably mounting said spark producing element between said two supporting walls.

3. A cigarette lighter as recited in claim 1 wherein a diameter of each of said driving sockets of said two side driving wheels is larger than an outer diameter of said two side turning wheels, and said striking teeth and said driving teeth are dispositioned rendering said two side driving wheels normally in free rotating condition.

4. A cigarette lighter as recited in claim 2 wherein a diameter of each of said driving sockets of said two side driving wheels is larger than an outer diameter of said two side turning wheels, and said striking teeth and said driving teeth are dispositioned rendering said two side driving wheels normally in free rotating condition.

* * * * *